US011749221B2

(12) United States Patent
Kang et al.

(10) Patent No.: US 11,749,221 B2
(45) Date of Patent: Sep. 5, 2023

(54) DRIVING METHOD OF ARRAY SUBSTRATE, AND ARRAY SUBSTRATE

(71) Applicants: BEIHAI HKC OPTOELECTRONICS TECHNOLOGY CO., LTD., Beihai (CN); HKC CORPORATION LIMITED, Shenzhen (CN)

(72) Inventors: Chih Tsung Kang, Beihai (CN); Haijiang Yuan, Beihai (CN)

(73) Assignees: BEIHAI HKC OPTOELECTRONICS TECHNOLOGY CO., LTD., Beihai (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/877,686

(22) Filed: Jul. 29, 2022

(65) Prior Publication Data

US 2023/0035132 A1 Feb. 2, 2023

(30) Foreign Application Priority Data

Jul. 30, 2021 (CN) ..... 202110878022.8

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01);
(Continued)

(58) Field of Classification Search
CPC ..... G09G 3/003; G09G 3/3614
See application file for complete search history.

(56) References Cited

U.S. PATENT DOCUMENTS

2004/0046714 A1 3/2004 Elliott
2016/0247822 A1* 8/2016 Chen ..... G09G 3/3688
(Continued)

FOREIGN PATENT DOCUMENTS

CN 104267519 A 1/2015
CN 105116656 A 12/2015
(Continued)

OTHER PUBLICATIONS

First Office Action issued in counterpart Chinese Patent Application No. 202110878022.8, dated Jun. 2, 2022.
(Continued)

*Primary Examiner* — Van N Chow
(74) *Attorney, Agent, or Firm* — Westbridge IP LLC

(57) ABSTRACT

Disclosed are a driving method of an array substrate and an array substrate. The driving method of the array substrate controls a data drive signal line to output a first polarity data drive signal in a first time period and output a second polarity data drive signal in a second time period alternately. In the first time period, the first polarity data drive signal is output to drive the first sub-pixels of each pixel group to make the first sub-pixel of each pixel group to be a first polarity. In the second time period, the second polarity data drive signal is output to drive the second sub-pixel of each pixel group to make the second sub-pixel of each pixel group to be a second polarity. Polarities of sub-pixels of each column are the same.

17 Claims, 4 Drawing Sheets

(52) U.S. Cl.
CPC ..... *G09G 2300/0842* (2013.01); *G09G 2320/0233* (2013.01)

(56) References Cited

U.S. PATENT DOCUMENTS

| | | | | |
|---|---|---|---|---|
| 2019/0189065 | A1 | 6/2019 | Wu et al. | |
| 2021/0049971 | A1* | 2/2021 | Xiao | G06F 3/0412 |
| 2023/0035132 | A1* | 2/2023 | Kang | G09G 3/3688 |

FOREIGN PATENT DOCUMENTS

| | | | |
|---|---|---|---|
| CN | 108333843 | A | 7/2018 |
| CN | 208189192 | U | 12/2018 |
| CN | 109523969 | A | 3/2019 |
| CN | 210155492 | U | 3/2020 |
| JP | WO2013014817 | A1 | 2/2015 |
| KR | 20020056707 | A | 7/2002 |

OTHER PUBLICATIONS

Grant Notification issued in counterpart Chinese Patent Application No. 202110878022.8, dated Dec. 26, 2022.

* cited by examiner

DRIVING METHOD OF ARRAY SUBSTRATE, AND ARRAY SUBSTRATE

CROSS-REFERENCE TO RELATED APPLICATIONS

The present application claims priority to Chinese Patent Application No. 202110878022.8, titled "Driving Method of Array Substrate, Array Substrate, And Display Panel" and filed on Jul. 30, 2021, which is hereby incorporated for reference in its entirety for all purposes.

TECHNICAL FIELD

The present application relates to the technical field of an array substrate, and in particular to a driving method of an array substrate and an array substrate.

BACKGROUND

A driving principle of the array substrate in the related art is generally the polarity inversion drive, that is, a position relationship of the liquid crystal molecules is changed dependent on a change of the voltage, the polarity inversion drive is to apply a voltage signal, whose positive polarity and negative polarity are changed, to liquid crystal molecules to achieve an alternative current drive of the liquid crystal molecules. The polarity inversion drive includes a row inversion drive, a column inversion drive, a frame inversion drive and a point inversion drive, and so on.

The present application is proposed based on the polarity inversion. When a row of pixel units are driven by two row scan lines, since the drive time of the array substrate keeps unchanged, and the row scan lines scan row by row, thus the scan drive time of pixel units of each row is reduced by half. That is, the charging time of each pixel unit is reduced by half. The polarity drive of sub-pixel signal in the same data drive signal line is switched to the reverse polarity. Because of the load effect caused by the parasitic capacitance effect generated by the data drive line and other electrodes, when the polarity drive of the data drive signal line is switched to reverse polarity, the load effect makes the signal of the data drive signal line not reach the required reverse polarity voltage immediately, thus there is a voltage response time. As shown in FIG. 3, the charging time TDn+1−m of the sub-pixel is the same as the charging time TDn+2−m of the sub-pixel Vpn+2−m, that is TDn+1−m=TDn+2−m, but since the charging signal of the sub-pixel is switched from the positive polarity signal VD1 (Vpn−m sub-pixel) of the data drive line VDm to the negative polarity signal VD2 (Vpn+1−m sub-pixel) relative to the common electrode signal Vcom. The parasitic capacitance effect produces a load effect to form different equivalent charging signals in the same charging time TDn+1−m=TDn+2−m. As shown in FIG. 3, if adjacent sub-pixels are charged with two opposite polarities respectively, the sub-pixel is undercharged, the brightness of the sub-pixel decreases, and one brighter row of sub-pixels and one darker row of sub-pixels are seen in space.

SUMMARY

The main purpose of the present application is to propose a driving method of an array substrate, aiming to solve a technical problem that bright and darker stripes are easily happened on display panels.

In order to achieve the above purpose, the present application provides a driving method of an array substrate, including:

a plurality of sub-pixels arranged in an array and divided into a plurality of pixel groups according to two adjacent columns of sub-pixels as a group, each pixel group comprising first sub-pixels and second sub-pixels provided in turn;

each of a plurality of data drive signal lines provided between two columns of sub-pixels of each pixel group and electrically connected to each sub-pixel of the pixel group;

a plurality of first row scan drive signal lines;

a plurality of second row scan drive signal lines;

in a same row, a first sub-pixel of each pixel group being connected to a first row scan drive signal line and a second sub-pixel of each pixel group being connected to a second row scan drive signal line, each column of sub-pixels being composed of first sub-pixels or second sub-pixels;

wherein the driving method of the array substrate includes:

controlling a data drive signal line to output a first polarity data drive signal in a first time period and output a second polarity data drive signal in a second time period alternately, outputting the first polarity data drive signal to drive the first sub-pixels of each pixel group to make the first sub-pixels of each pixel group to be a first polarity in the first time period; and outputting the second polarity data drive signal to drive the second sub-pixels of each pixel group to make the second sub-pixels of each pixel group to be a second polarity in the second time period, wherein polarities of sub-pixels of each column of sub-pixels are same.

In one embodiment, the outputting the first polarity data drive signal to drive the first sub-pixels of each pixel group includes:

driving first sub-pixels of each row connected to the first row scan drive signal line in turn with the first polarity data drive signal along an extension direction of the data drive signal line.

In one embodiment, the outputting the second polarity data drive signal to drive the second sub-pixels of each pixel group includes:

driving second sub-pixels of each row connected to the second row scan drive signal line in turn with the second polarity data drive signal along an extension direction of the data drive signal line.

In order to achieve the above purpose, the present application provides a driving method of an array substrate, including:

a plurality of sub-pixels arranged in an array and divided into a plurality of first pixel groups and a plurality of second pixel groups according to two adjacent columns of sub-pixels as a group, the plurality of first pixel groups and the plurality of second pixel groups being arranged alternatively along rows where the plurality of first pixel groups and the plurality of second pixel groups are located, each of the plurality of first pixel groups and the plurality of second pixel groups includes first sub-pixels and second sub-pixels arranged in turn;

a plurality of data drive signal lines, each data drive signal line being provided between two columns of sub-pixels of each pixel group and electrically connected to sub-pixels of each pixel group;

a plurality of first row scan drive signal lines;

a plurality of second row scan drive signal lines;

wherein in a same row, first sub-pixel of each pixel group being connected to a first row scan drive signal line and second sub-pixels of each pixel group being connected to a second row scan drive signal line, wherein each column of sub-pixels is composed of any one of the first sub-pixels of a first pixel group, second sub-pixels of the first pixel group, the first sub-pixels of a second pixel group, and the second sub-pixels of the second pixel group, wherein a data drive signal line connected to a first pixel group is a first data drive signal line and a data drive signal line connected to the second pixel group is a second data drive signal line;

wherein the driving method of the array substrate includes:

controlling a data drive signal line to output a first polarity data drive signal in a first time period and output a second polarity data drive signal in a second time period alternately;

outputting the first polarity data drive signal to drive the first sub-pixels of the first pixel group in the first time period, and outputting the second polarity data drive signal to drive the first sub-pixels of the second pixel group; and in the second time period, outputting, by the first data drive signal line, the second polarity data drive signal to the second row scan drive signal line to drive the second sub-pixels of the first pixel group, outputting, by the second data drive signal line, the first polarity data drive signal to the second row scan drive signal line to drive the second sub-pixel of the second pixel group, a polarity of one of two sub-pixels of the first pixel group being a first polarity and a polarity of the other of the two sub-pixels of the first pixel group being a second polarity, and a polarity of two sub-pixels of the second pixel group being the first polarity and a polarity of the other of the two sub-pixels of the second pixel group being the second polarity, wherein a polarity of each column of sub-pixels is a polarity of each sub-pixel of a first row.

In one embodiment, the first polarity represents a voltage of the first polarity data drive signal greater than a voltage of a common electrode; and the second polarity represents a voltage of the second polarity data drive signal less than the voltage of the common electrode.

In one embodiment, a time span of the first time period is equal to that of the second time period.

In order to achieve the above purpose, the present application provides an array substrate, including a memory storing a driving program of the array substrate;

a processor for executing the driving program of the array substrate to realize the driving method of the array substrate according to claim 1:

a plurality of sub-pixels arranged in an array and being divided into a plurality of pixel groups according to two adjacent columns of sub-pixels as a group, each pixel group comprising first sub-pixels and second sub-pixels provided in turn;

each of a plurality of data drive signal lines provided between two columns of sub-pixels of each pixel group and electrically connected to each sub-pixel of the pixel group;

a plurality of first row scan drive signal lines;

a plurality of second row scan drive signal lines;

in a same row, a first sub-pixel of each pixel group being connected to a first row scan drive signal line and a second sub-pixel of each pixel group being connected to a second row scan drive signal line.

In order to achieve the above purpose, the present application provides an array substrate, including a memory storing a driving program of the array substrate;

a processor for executing the driving program of the array substrate to realize the driving method of the array substrate as mentioned above;

a plurality of sub-pixels arranged in an array and being divided into a plurality of first pixel groups and a plurality of second pixel groups according to two adjacent columns of sub-pixels as a group, wherein sub-pixels of the first pixel group and sub-pixels of the second pixel group are arranged alternatively along rows where they are located, and the first pixel group and the second pixel group both comprising first sub-pixels and second sub-pixels provided in turn;

each of a plurality of data drive signal lines provided between two columns of sub-pixels of each pixel group and electrically connected to each sub-pixel of the pixel group;

a plurality of first row scan drive signal lines;

a plurality of second row scan drive signal lines;

in a same row, a first sub-pixel of each pixel group being connected to a first row scan drive signal line and a second sub-pixel of each pixel group being connected to a second row scan drive signal line, wherein each column of sub-pixels is composed of any one of the first sub-pixel of the first pixel group, the second sub-pixel of the first pixel group, the first sub-pixel of the second pixel group, and the second sub-pixel of the second pixel group, wherein a data drive signal line connected to the first pixel group is a first data drive signal line, and a data drive signal line connected to the second pixel group is a second data drive signal line.

In one embodiment, the array substrate further includes a plurality of common electrode signal lines, each common electrode signal line being provided between two adjacent groups of pixels;

in each column of sub-pixels, a common electrode storage capacitor being provided between each sub-pixel and an adjacent common electrode signal line, one end of each common electrode storage capacitor being connected to a corresponding common electrode signal line, and the other end of each of common electrode storage capacitor being connected to a pixel electrode of a corresponding sub-pixel.

In order to achieve the above purpose, the present application provides a display panel, including a color film substrate, a liquid crystal, and an array substrate as mentioned above, the array substrate, the liquid crystals, and the color film substrate being stacked in turn.

A control method of the array substrate of the technical solution of the present application is implemented based on the array substrate. The array substrate includes a plurality of sub-pixels, a plurality of data drive signal lines, a plurality of first row scan drive signal lines and a plurality of second row scan drive signal lines. The plurality of sub-pixels are arranged in an array and divided into a plurality of pixel groups according to two adjacent columns of sub-pixels as a group. Each of a plurality of data drive signal lines is provided between two columns of sub-pixels of each pixel group and electrically connected to each sub-pixel of each pixel group. Each row of sub-pixels is divided into the first pixel group and the second pixel group. Each pixel group includes a first sub-pixel and a second sub-pixel provided in turn. In a same row, a first sub-pixel of each pixel group is connected to the first row scan drive signal line and a second sub-pixel of each pixel group is connected to the second row scan drive signal line. Each column of sub-pixels is composed of first sub-pixels or second sub-pixels. The driving method of the array substrate controls the data drive signal line to output a first polarity data drive signal in a first time period and output a second polarity data drive signal in a second time period alternately. In the first time period, the first polarity data drive signal is output to drive the first sub-pixel of each pixel group to make the first sub-pixel of each pixel group to be a sub-pixel of a first polarity. In the second time period, the second polarity data drive signal is output to drive the second sub-pixel of each pixel group to make the second sub-pixel of each pixel group to be a sub-pixel of a second polarity, and a polarity of each column of sub-pixels is the same. With the above solution, the sub-pixels of the first pixel group and the second pixel group of each row connected to the data drive signal lines are driven in different time periods, so that only the first sub-pixel of each pixel group is charged and lighted by the first polarity and/or the second sub-pixel of each pixel group is charged and lighted by the second polarity. Since the sub-pixels of each pixel group are arranged alternately, and the first sub-pixel of the current pixel group is in the same column as the first sub-pixel of the corresponding pixel group of other rows, and the second sub-pixel of the current pixel group is in the same column as the second sub-pixel of the corresponding pixel group of other rows, so that the polarities of each column of sub-pixels are the same and sub-pixels of each column of sub-pixels are evenly spaced or all lighted. Thus the pattern are uniformly displayed and the sufficient charging time is ensured to completely charge. One brighter row of sub-pixels and one darker row of sub-pixels are avoided. The light and dark stripes are not easily happened on the display panel.

BRIEF DESCRIPTION OF THE DRAWINGS

In order to more clearly explain the embodiments of the present application or the technical solutions in the related art, the following will briefly introduce the drawings in the embodiments or the description of the related art. It is obvious that the drawings described below are only some embodiments of the present application. For those skilled in the art, other drawings can be obtained according to the structure shown in these drawings without paying creative labor.

The realization of the purpose, functional features and advantages of the present application will be further described in conjunction with the embodiments, with reference to the accompanying drawings.

DETAILED DESCRIPTION OF THE EMBODIMENTS

The technical solution in the embodiment of the present application will be clearly and completely described below in combination with the accompanying drawings in the embodiment of the present application. If there are descriptions involving "first", "second" and so on in the embodiment of the present application, the descriptions of "first", "second" and so on are only for descriptive purposes, and cannot be understood as indicating or implying its relative importance or implicitly indicating the number of indicated technical features. Thus, the features defined with "first" and "second" can include at least one of the features explicitly or implicitly.

The present application proposes a driving method of an array substrate to solve a technical problem that light and dark stripes are easily produced on display panels.

Figure 2:
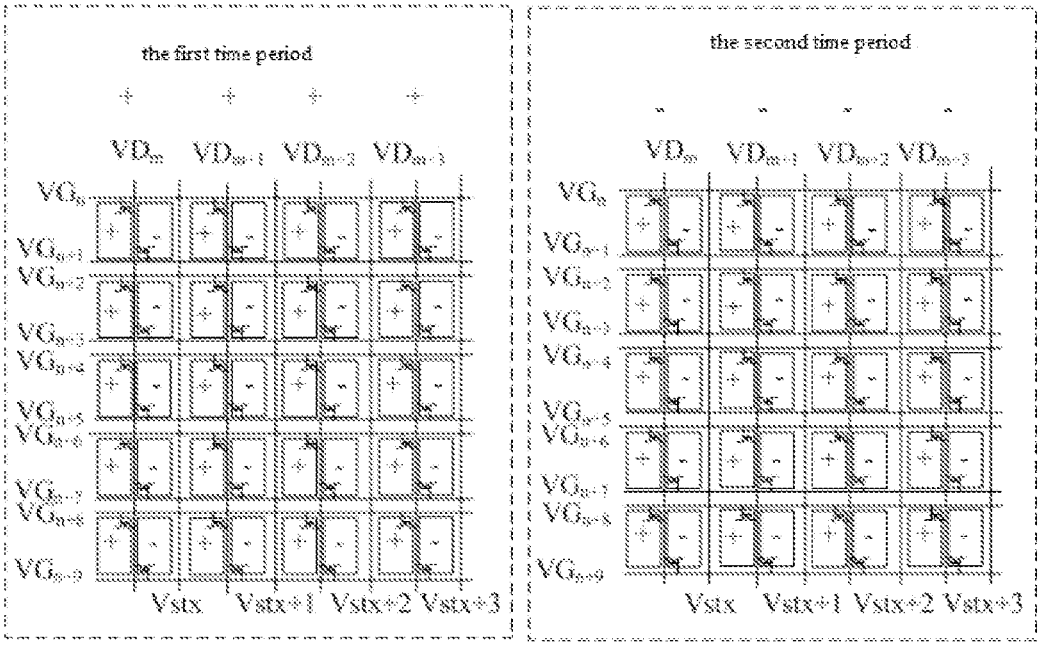
FIG. 2 is a structural diagram of an embodiment of the array substrate according to the present application.
Figure 3:
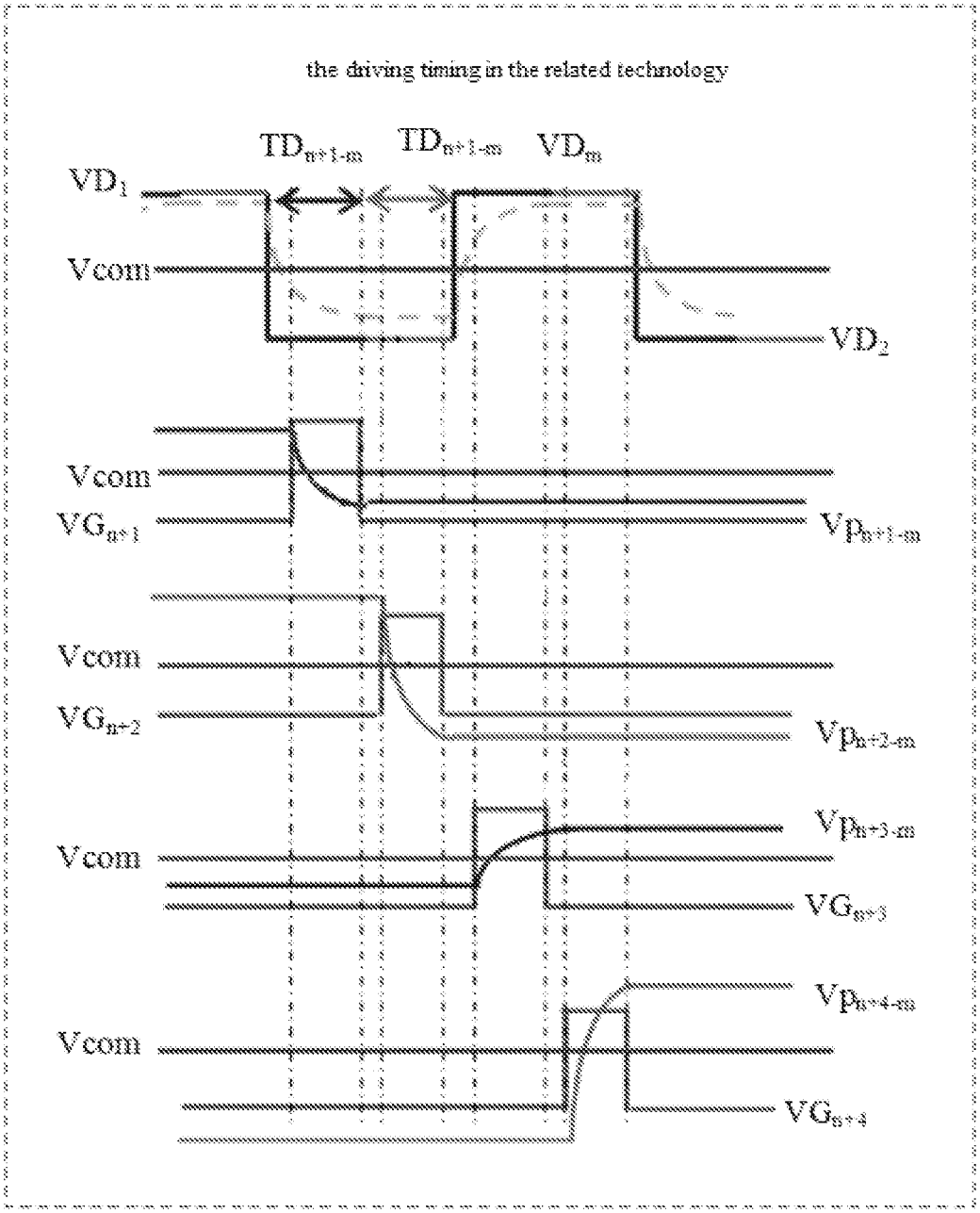
FIG. 3 is a schematic diagram of driving timing of the array substrate in the exemplary technology.

In one embodiment, the driving method of the array substrate of the present application is realized based on an array substrate. As shown in FIG. 2, the array substrate includes a plurality of sub-pixels, a plurality of data drive signal lines ($VD_m$, $VD_{m+1}$, $VD_{m+2}$, . . . , $VD_{m+z}$), a plurality of first row scan drive signal lines ($VG_n$, $VG_{n+2}$, $VG_{n+4}$ . . . $VG_{n+2z}$) corresponding to a plurality of rows of sub-pixels one-to-one, and a plurality of second row scan drive signal lines ($VG_{n+1}$, $VG_{n+3}$, $VG_{n+5}$ . . . $VG_{n+2z+1}$) corresponding to the plurality of rows of sub-pixels. A plurality of sub-pixels are arranged in an array and divided into a plurality of pixel groups according to two adjacent columns of sub-pixels as a group. Each pixel group includes a first sub-pixel and a second sub-pixel provided in turn. In the same row, first sub-pixels of each pixel group are connected to the first row scan drive signal lines ($VG_n$, $VG_{n+2}$, $VG_{n+4}$, . . . , $VG_{n+2z}$), and second sub-pixels of each pixel group are connected to the second row scan drive signal lines ($VG_{n+1}$, $VG_{n+3}$, $VG_{n+5}$ . . . $VG_{n+2z+1}$). Each column of sub-pixels is composed of the first sub-pixels or the second sub-pixels. n, m, z are greater than 1.

Figure 1:
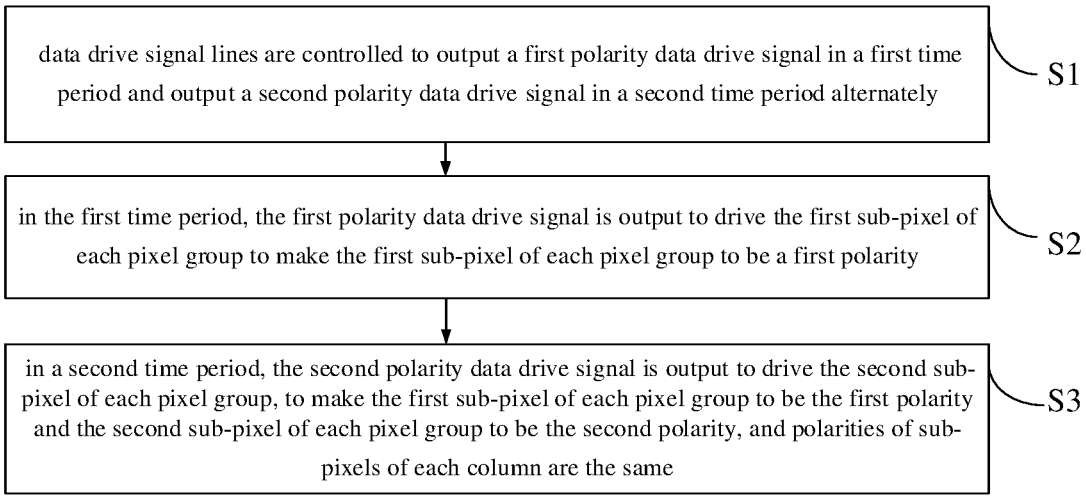
FIG. 1 is a flowchart diagram of an embodiment of a driving method of an array substrate according to the present application.

Referring to FIGS. 1 and 2, the driving method of the array substrate of the present application includes:

S1, data drive signal lines ($VD_m$, $VD_{m+1}$, $VD_{m+2}$ . . . $VD_{m+z}$) are controlled to output a first polarity data drive signal in a first time period and output a second polarity data drive signal in a second time period alternately.

The first time period and the second time period form one period. The data drive signal line outputs the first polarity data drive signal and the second polarity data drive signal alternately in this period.

S2, referring to the schematic diagram on a left side of FIG. 2, in the first time period, the first polarity data drive signal is output to drive the first sub-pixel of each pixel group to make the first sub-pixel of each pixel group to be a first polarity.

Each of all data drive signal lines ($VD_m$, $VD_{m+1}$, $VD_{m+2}$ . . . $VD_{m+z}$) outputs the first polarity data drive signal. Referring to FIG. 2, after the driving of the first time period, the pixels of the array substrate are arranged in such way that sub-pixels of the first polarity and sub-pixels of the second polarity of each row are arranged alternately along rows where they are located. The first sub-pixel of each pixel group is in the same column as the first sub-pixels of corresponding pixel groups of other rows, and the second sub-pixel of each pixel group is in the same column as the second sub-pixels of corresponding pixel groups of other rows, so that the lighted sub-pixels are arranged alternately in columns. The whole array substrate seems to be uniformly lighted, and one brighter pixel row or one darker pixel row is avoided. In addition, each row scan signal can be output to each first row scan drive signal line ($VG_n$, $VG_{n+2}$, $VG_{n+4}$ . . . $VG_{n+2z}$), and each first row scan drive signal line ($VG_n$, $VG_{n+2}$, $VG_{n+4}$ . . . $VG_{n+2z}$) outputs the row scan signal to the first sub-pixel of each pixel group connected thereto to charge the corresponding pixel group and make the first sub-pixel of each pixel group to be the first polarity, thus the drive and light of the first sub-pixel of each pixel group in the array substrate is realized.

S3, referring to the schematic diagram on the right side of FIG. 2, in a second time period, the second polarity data drive signal is output to drive the second sub-pixel of each pixel group, to make the first sub-pixel of each pixel group to be the first polarity and the second sub-pixel of each pixel group to be the second polarity, and polarities of sub-pixels of each column are the same.

Each of the data drive signal lines ($VD_m$, $VD_{m+1}$, $VD_{m+2}$ . . . $VD_{m+z}$) outputs the second polarity data drive signal, and each of the second row scan drive signal lines ($VG_{n+1}$, $VG_{n+3}$, $VG_{n+5}$ . . . $VG_{n+2z+1}$) outputs the row scan signal to the second sub-pixel of each pixel group connected thereto, to charge the corresponding pixel group and make a polarity of the second sub-pixel of each pixel group to be the second polarity, thereby the first sub-pixel and the second sub-pixel of each pixel group in the array substrate are driven and lighted. Since the first sub-pixel of each pixel group lighted in a previous time period is the first polarity and is discharged, it gradually changes from bright to dark. The overall array substrate thus becomes darker gradually. When brighter, one brighter row of the pixels or one darker row of the pixels won't happen. After the sub-pixel of the first polarity becomes darker, since the pixels of the array substrate are arranged in such way that the sub-pixels of the first polarity and the sub-pixels of the second polarity are arranged alternately along rows where they are located, as shown in FIG. 2, and the first sub-pixel of each pixel group of each row is in the same column as the first sub-pixels of the corresponding pixel groups of other rows, and the second sub-pixel of each pixel group of each row is in the same column as the second sub-pixels of corresponding pixel groups of other rows, thus, the lighted sub-pixels are arranged alternately in columns. The whole array substrate seems to be uniformly lighted, and one brighter pixel row or one darker pixel row is avoided. In addition, the row scan signal is output to each of the second row scan drive signal lines ($VG_{n+1}$, $VG_{n+3}$, $VG_{n+5}$ . . . $VG_{n+2z+1}$).

According to the above solution, the data drive signal lines ($VD_m$, $VD_{m+1}$, $VD_{m+2}$ . . . , $VD_{m+z}$) are connected to the first sub-pixel and the second sub-pixel of each pixel group to drive the first sub-pixel in the first time period and to drive the second sub-pixel in the second time period, so that only the first sub-pixel of each pixel group is charged and lighted by the first polarity and/or the second sub-pixel of each pixel group is charged and lighted by the second polarity. Since the first sub-pixel and the second sub-pixel of each pixel group are arranged alternately and the first sub-pixel of each pixel group is in the same column as the first sub-pixel of corresponding pixel groups of other rows. The second sub-pixel of each pixel group is in the same column as the second sub-pixel of corresponding pixel groups of other rows, thus polarities of sub-pixels of each column are the same and the sub-pixels are evenly spaced or all are lighted to make the displayed pattern uniform and have sufficient charging time for completely charge. One brighter row of sub-pixels and one darker row are avoided, the bright and dark stripes are not easily happened on the display panel.

It should be noted that since an interval from the first time period to the second time period is basically less than the perception time of the user's eyes, i.e., the transient effect of the human eye. The brightness change is difficultly perceived by the user. The problem that the bright and dark stripes occur on the display panel is solved, and the user's use and the brightness adjustment function are not affected.

In one embodiment, the first polarity is that a voltage of the first polarity data drive signal is greater than that of a common electrode. The second polarity is that a voltage of the second polarity data drive signal is less than that of the common electrode.

The first polarity of the first polarity data drive signal and the second polarity of the second polarity data drive signal do not refer to a positive voltage or a negative voltage, but to voltages compared to the voltage of the common electrode of the array substrate, i.e., the voltage of the first polarity data drive signal greater than that of the common electrode corresponds to the first polarity and the voltage of the second polarity data drive signal less than that of the common electrode corresponds to the second polarity.

In another embodiment, the second polarity is that the voltage of the first polarity data drive signal is greater than that of the common electrode, and the first polarity is that the voltage of the second polarity data drive signal is less than that of the common electrode.

In one embodiment, a time span of the first time period is equal to that of the second time period.

A time span of the first time period equal to that of the second time period is ensured, which can ensured the display balance of the whole display panel. And one bright row of sub-pixels and one darker row of sub-pixels won't happen. The brightness deviation of the display panel at all the time spans can be reduced.

In one embodiment, the outputting the first polarity data drive signal to drive the first sub-pixel of each pixel group includes:

crossing the row scan drive signal lines ($VG_n$, $VG_{n+1}$, $VG_{n+2}$, $VG_{n+3}$, $VG_{n+4}$, $VG_{n+5}$, . . . , $VG_{n+z}$) along an extension direction of the data drive signal lines to drive the first sub-pixel of each row connected to the first row scan drive signal line in turn with a first polarity data drive signal.

The first sub-pixels of pixel groups of rows are driven with the first polarity data drive signal in turn along the extension direction of the data drive signal line crossing the row scan drive signal lines ($VG_n$, $VG_{n+1}$, $VG_{n+2}$, $VG_{n+3}$, $VG_{n+4}$, $VG_{n+5}$ . . . $VG_{n+z}$), the first sub-pixels of pixel groups of columns is thus charged and lighted row by row. It is effectively avoided that there is a sub-pixel not lighted, and the stability of uniform display is improved.

In one embodiment, the operation of outputting the second polarity data drive signal to drive the second sub-pixel of each pixel group includes:

driving the second sub-pixel of rows, connected to the second row scan drive signal line, in turn with the second polarity data drive signal along the extension direction of the data drive signal lines ($VD_m$, $VD_{m+1}$, $VD_{m+2}$ . . . $VD_{m+z}$).

The second sub-pixel of the pixel groups connected to the current data drive signal line is driven in turn with a second polarity data drive signal along the extension direction of the data drive signal lines ($VD_m$, $VD_{m+1}$, $VD_{m+2}$ . . . $VD_{m+z}$) crossing the row scan drive signal lines ($VG_n$, $VG_{n+1}$, $VG_{n+2}$, $VG_{n+3}$, $VG_{n+4}$, $VG_{n+5}$ . . . ), so that the second sub-pixels of the rows are charged and lighted row by row. It is effectively avoided that there is a sub-pixel not lighted, and the stability of uniform display is improved.

To achieve the above purpose, the present application also proposes a driving method of the array substrate. The driving method of the array substrate is achieved based on the array substrate shown in FIG. 6. The array substrate includes a plurality of sub-pixels, a plurality of data drive signal lines, a plurality of first row scan drive signal lines ($VG_n$, $VG_{n+2}$, $VG_{n+4}$, . . . , $VG_{n+2z}$) corresponding to a plurality of sub-pixels one-to-one and a plurality of second row scan drive signal lines corresponding to a plurality of rows of sub-pixels ($VG_{n+1}$, $VG_{n+3}$, $VG_{n+5}$ . . . $VG_{n+2z+1}$)

one-to-one. The plurality of sub-pixels are arranged in an array and divided into a plurality of first pixel groups and second pixel groups according to two adjacent columns of sub-pixels as a group. The first pixel groups and the second pixel groups are arranged alternately along rows where they are located. The first pixel group and the second pixel group both include a plurality of first sub-pixels and a plurality of second sub-pixels. The first sub-pixel of each pixel group is connected to the first row scan drive signal line ($VG_n$, $VG_{n+2}$, $VG_{n+4}$ . . . $VG_{n+2z}$), and the second sub-pixel of each pixel group is connected to the second row scan drive signal line ($VG_{n+1}$, $VG_{n+3}$, $VG_{n+5}$ . . . $VG_{n+2z+1}$). The first sub-pixel of the first pixel group of each row is in the same column as the first sub-pixels of the first pixel groups of the other rows. Each data drive signal line is provided between two columns of sub-pixels of each group and is electrically connected to each sub-pixel of the two columns of sub-pixels of the group. In the same row, the first sub-pixel of each pixel group is connected to the first row scan drive signal line and the second sub-pixel of each pixel group is connected to the second row scan drive signal line. Each column of sub-pixels is composed of any one of the first sub-pixel of the first pixel group, the second sub-pixel of the first pixel group, the first sub-pixel of the second pixel group, the second sub-pixel of the second pixel group. The data drive signal line connected to the first pixel group is a first data drive signal line ($VD_m$, $VD_{m+2}$, . . . , $VD_{m+z}$). The data drive signal line connected to the second pixel group is a second data drive signal line ($VD_{m+1}$, $VD_{m+3}$ . . . $VD_{m+z}$).

Figure 5:
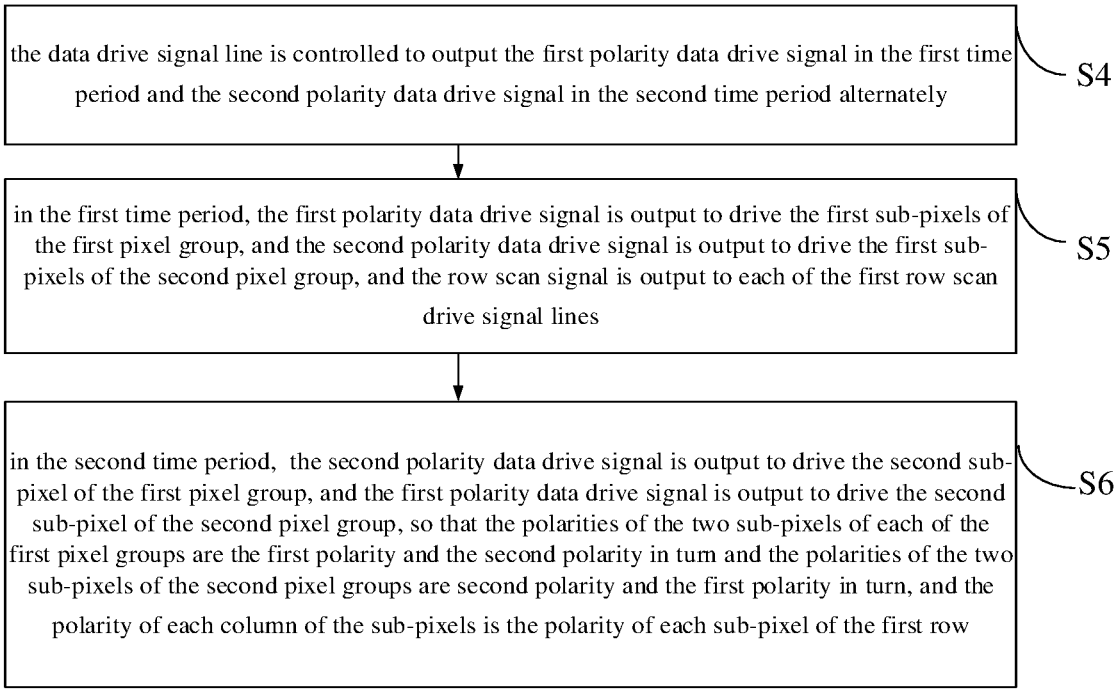
FIG. 5 is a flowchart diagram of an embodiment of the driving method of the array substrate according to the present application.

As shown in FIG. 5, the driving method of the array substrate of the present application includes:

S4, the data drive signal line is controlled to output the first polarity data drive signal in the first time period and the second polarity data drive signal in the second time period alternately.

The first time period and the second time period form a completed period, and the data drive signal line outputs alternately the first polar data drive signal and the second polar data drive signal during the completed period.

Figure 6:
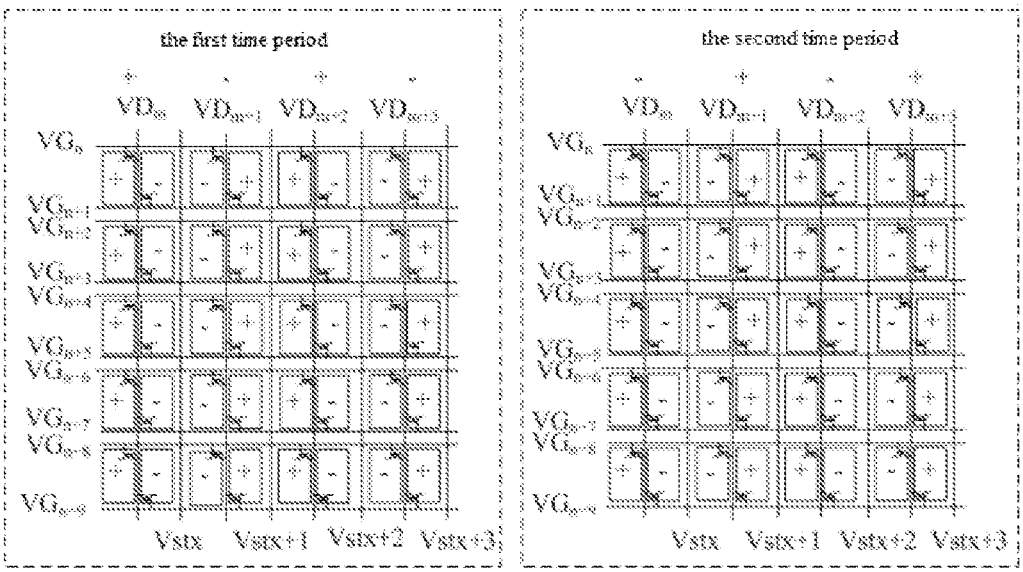
FIG. 6 is a structural diagram of an embodiment of the array substrate according to the present application.

S5, in the first time period, referring to the schematic diagram of the array substrate on the left side of FIG. 6, the first polarity data drive signal is output to drive the first sub-pixels of the first pixel group, and the second polarity data drive signal is output to drive the first sub-pixels of the second pixel group, and the row scan signal is output to each of the first row scan drive signal lines ($VG_n$, $VG_{n+2}$, $VG_{n+4}$ . . . $VG_{n+2z}$).

The data drive signal lines ($VD_m$, $VD_{m+2}$ . . . $VD_{m+2z}$) connected to the first pixel group outputs the first polarity data drive signal. Each of the first row scan drive signal lines ($VG_n$, $VG_{n+2}$, $VG_{n+4}$ . . . $VG_{n+2z}$) outputs the row scan signal to the first sub-pixel of the first pixel group of each row connected thereto to charge the corresponding pixel groups to make the first sub-pixel of the first pixel group of each row to be a sub-pixel of the first polarity. The data drive signal lines ($VD_{m+1}$, $VD_{m+3}$ . . . $VD_{m+2z+1}$) connected to the second pixel group output the second polarity data drive signal to drive the first sub-pixel of the second pixel group of each row. Each of the first row scan drive signal lines ($VG_n$, $VG_{n+2}$, $VG_{n+4}$ . . . $VG_{n+2z}$) outputs the row scan signal to the first sub-pixel of the second pixel groups of each row connected thereto to charge the corresponding pixel groups to make the first sub-pixels of the second pixel groups of each row to be a sub-pixel of the second polarity. The sub-pixels of the array substrate are driven and lighted by the above process. Since the pixels of the array substrate are arranged in such way that the sub-pixels of the first polarity and the sub-pixels of the second polarity of each row alternately along rows where they are located, and the first sub-pixel group of each row is in the same column as the first sub-pixel groups of other rows, and the second sub-pixel group of each row is in the same column as the second sub-pixel groups of other rows, so that the lighted sub-pixels are arranged alternately in columns, and the array substrate on a whole seems to be lighted unevenly, thus one brighter row of sub-pixels and one darker row of sub-pixels are avoided.

S6, in the second time period, referring to the schematic diagram on the right side of FIG. 6, the first data drive signal line outputs the second polarity data drive signal to the second row scan drive signal line to drive the second sub-pixel of the first pixel group, and the second data drive signal line outputs the first polarity data drive signal to drive the second sub-pixel of the second pixel group and outputs the row scan signal to each of the second row scan drive signal lines ($VG_{n+1}$, $VG_{n+3}$, $VG_{n+5}$ . . . $VG_{n+2z+1}$), so that the polarities of the two sub-pixels of each of the first pixel groups are the first polarity and the second polarity in turn. The polarities of the two sub-pixels of the second pixel groups are second polarity and the first polarity in turn, and the polarity of each column of the sub-pixels is the polarity of each sub-pixel of the first row.

The data drive signal lines ($VD_m$, $VD_{m+1}$, $VD_{m+2}$ . . . $VD_{m+z}$) connected to the first pixel group output the second polarity data drive signal. Each of the second row scan drive signal lines ($VG_{n+1}$, $VG_{n+3}$, $VG_{n+5}$ . . . $VG_{n+2z+1}$) outputs the row scan signal to the second sub-pixel of the first pixel group of each row connected thereto to charge the corresponding pixel group to make the second sub-pixel of the first pixel group of each row to be the sub-pixel of the second polarity, and the data drive signal lines ($VD_{m+1}$, $VD_{m+3}$ . . . $VD_{m+2z+1}$) connected to the second pixel group output the first polarity data drive signal to drive the second sub-pixel of the second pixel group of each row, and each of the second row scan drive signal lines ($VG_{n+1}$, $VG_{n+3}$, $VG_{n+5}$ . . . $VG_{n+2z+1}$) outputs the row scan signal to the second sub-pixel of the second pixel group of each row connected thereto to charge the corresponding pixel group to make the second sub-pixel of the second pixel group of each row to be sub-pixel of the second polarity. Since the first sub-pixel of the first pixel group and the first sub-pixel of the second pixel group of each row lighted in the previous time period are the sub-pixel of the first polarity and are discharged, they gradually become darker from bright, so that the overall brightness of the display panel is gradually darker from bright, and when brighter, one brighter row of sub-pixels and one darker row of sub-pixels won't happen. After the sub-pixel of the first polarity becomes dark, since the pixels of the array substrate are arranged in such way that the sub-pixel of the first polarity and the sub-pixel of the second polarity are arranged alternatively along rows where they are located. The first sub-pixels of the first pixel groups of each row is in the same column as the first sub-pixels of the first pixel groups of other rows, the second sub-pixels of the first pixel groups of each row is in the same column as the second sub-pixels of the first pixel groups of other rows, the first sub-pixels of the second pixel groups of each row is in the same column as the first sub-pixels of the second pixel groups of other rows, and the first sub-pixels of the second pixel groups of each row is in the same column as the first sub-pixel of the second pixel group of other rows. The second sub-pixels of the second pixel groups of each row is in the same column as the second sub-pixels of the second pixel group of other rows, so that the lighted sub-pixels are arranged alternately in columns, and the array substrate on a whole seems to be lighted unevenly, thus one brighter row of sub-pixels and one darker row of sub-pixels are avoided.

With the above solution, sub-pixels of the first pixel group and the second pixel group of each row connected to the data drive signal lines ($VD_m$, $VD_{m+1}$, $VD_{m+2}$ . . . $VD_{m+z}$) are driven in different time periods, so that only the first sub-pixel of the first pixel group is charged and lighted by the first polarity and the first sub-pixel of the second pixel group is charged and lighted by the second polarity, and/or the second sub-pixel of the first pixel group is charged and lighted by the second polarity and the second sub-pixel of the second pixel group is charged and lighted by the first polarity. Since the first pixel group and the second pixel group of each row are arranged alternately, and the first sub-pixel of the first pixel group of each row is in the same column as the first sub-pixels of the first pixel groups of the other rows, the second sub-pixel of the first pixel group of each row is in the same column as the second sub-pixels of the first pixel groups of the other rows, and the first sub-pixel of the second pixel group of each row is in the same column as the second sub-pixel of the second pixel group of each row is in the same column as the second sub-pixel of the second pixel group of other rows, so that the polarities of each column of sub-pixels are the same and sub-pixels of each column of sub-pixels are evenly spaced or all lighted. Thus the pattern are uniformly displayed and the sufficient charging time is ensured to completely charge. One brighter row of sub-pixels and one darker row of sub-pixels are avoided. The light and dark stripes are not easily happened on the display panel.

In one embodiment, it should be noted that since an interval from the first time period to the second time period is basically less than the perception time of the user's eyes, i.e., the transient effect of the human eye. The brightness change is difficultly perceived by the user. A problem is solved that the bright and dark stripes happen on the display panel, and the user's use and the brightness adjustment function are not affected.

In one embodiment, the first polarity is that a voltage of the first polarity data drive signal is greater than that of a common electrode. The second polarity is that a voltage of the second polarity data drive signal is less than a voltage of the common electrode.

The first polarity of the first polarity data drive signal and the second polarity of the second polarity data drive signal do not refer to a positive voltage or a negative voltage, but to voltages compared to the voltage of the common electrode of the array substrate, i.e., that the voltage of the first polarity data drive signal is greater than that of the common electrode is of the first polarity and that the voltage of the second polarity data drive signal less than that of the common electrode is of the second polarity.

In another embodiment, the second polarity is that the voltage of the first polarity data drive signal is greater than that of the common electrode, and the first polarity is that the voltage of the second polarity data drive signal is less than that of the common electrode.

In one embodiment, a time span of the first time period is equal to a time span of the second time period.

Ensuring that the time spans of the first time period and the second time period are equal, the display balance of the display panel on the whole can be ensured. And one row bright of sub-pixels and one darker row of sub-pixels won't happen. The brightness deviation of the display panel at all the time spans can be reduced.

In one embodiment, the outputting a first polarity data drive signal to drive the first sub-pixel of each pixel group includes:

crossing the row scan drive signal lines ($VG_n$, $VG_{n+1}$, $VG_{n+2}$, $VG_{n+3}$, $VG_{n+4}$, $VG_{n+5}$, . . . , $VG_{n+z}$) along an extension direction of the data drive signal lines to drive the first sub-pixel of each row connected to the first row scan drive signal line in turn with a first polarity data drive signal.

The first sub-pixel of the sub-pixel group of each row is driven with the first polarity data drive signal in turn along the extension direction of the data drive signal line crossing the row scan drive signal line ($VG_n$, $VG_{n+1}$, $VG_{n+2}$, $VG_{n+3}$, $VG_{n+4}$, $VG_{n+5}$ . . . $VG_{n+z}$), the first sub-pixel of the first pixel group of each row is thus charged and lighted row by row. The first sub-pixel of second pixel group connected to the first row scan drive signal line is driven with the second polarity data drive signal in turn along the extension direction of the data drive signal line crossing the row scan drive signal line ($VG_n$, $VG_{n+1}$, $VG_{n+2}$, $VG_{n+3}$, $VG_{n+4}$, $VG_{n+5}$ . . . $VG_{n+z}$), the first sub-pixel of second pixel group of each column is thus charged and lighted row by row. It is effectively avoided that there is not lighted sub-pixel, and the stability of uniform display is improved.

In one embodiment, the operation of outputting a second polarity data drive signal to drive a second sub-pixel of each pixel group includes: the second sub-pixel of each row connected to the second row scan drive signal line is driven in turn with the second polarity data drive signal along the extension direction of the data drive signal lines ($VD_m$, $VD_{m+1}$, $VD_{m+2}$ . . . $VD_{m+z}$).

The second sub-pixel of each pixel group connected to the current data drive signal line is driven in turn with a second polarity data drive signal along the extension direction of the data drive signal line ($VD_m$, $VD_{m+1}$, $VD_{m+2}$ . . . $VD_{m+z}$) crossing the row scan drive signal lines ($VG_n$, $VG_{n+1}$, $VG_{n+2}$, $VG_{n+3}$, $VG_{n+4}$, $VG_{n+5}$ . . . ) so that the second sub-pixel of each row is charged and lighted row by row. It is effectively avoided that there is not lighted sub-pixel, and the stability of uniform display is improved.

In one embodiment, the operation of the first data drive signal line outputs a second polarity data drive signal to the second row scan drive signal line to drive the second sub-pixel of the first pixel group of each row, and the second data drive signal line outputs a first polarity data drive signal to the second row scan drive signal line to drive the second sub-pixel of the second pixel group of each row includes:

the second sub-pixel of the first pixel group connected to the second row scan drive signal line is driven in turn with the second polar data drive signal along the extension direction of the data drive signal line ($VD_m$, $VD_{m+1}$, $VD_{m+2}$ . . . $VD_{m+z}$);

the second sub-pixel of the second pixel group connected to the second row scan drive signal line is driven in turn with the first polarity data drive signal along the extension direction of the data drive signal lines ($VD_m$, $VD_{m+1}$, $VD_{m+2}$ . . . $VD_{m+z}$).

The second sub-pixel of the first pixel group of two column of sub-pixels connected to the second row scan drive signal line is driven in turn with the second polarity data drive signal along the extension direction of the data drive signal line ($VD_m$, $VD_{m+1}$, $VD_{m+2}$ . . . $VD_{m+z}$) crossing the row scan drive signal line ($VG_n$, $VG_{n+1}$, $VG_{n+2}$, $VG_{n+3}$, $VG_{n+4}$, $VG_{n+5}$ . . . $VG_{n+z}$), so that the second sub-pixel of the first pixel group of each row of sub-pixels is charged and lighted row by row. The second sub-pixel of the second pixel group connected to the second row scan drive signal line is driven in turn with the first polarity data drive signal along the extension direction of the data drive signal line ($VD_m$, $VD_{m+1}$, $VD_{m+2}$ . . . $VD_{m+z}$) crossing the row scan drive signal line ($VG_n$, $VG_{n+1}$, $VG_{n+2}$, $VG_{n+3}$, $VG_{n+4}$, $VG_{n+5}$ . . . $VG_{n+z}$), so that the second sub-pixel of the second pixel group of each column of sub-pixels is charged and lighted row by row. Since the first sub-pixel of the first pixel group and the first sub-pixel of the second pixel group of each row lighted in the previous time period are the sub-pixel of the first polarity and discharged, and they gradually become darker from bright. Therefore, the overall brightness of the display panel is from brighter to darker, and the pixels of the array substrate are arranged in such way that the sub-pixels of the first polarity and the sub-pixels of the second polarity are arranged alternately along rows where they are located, and the first sub-pixel of the first pixel group of each row is in the same column as the first sub-pixel of the first pixel group of other rows, and the second sub-pixel of the first pixel group of each row is in the same column as the second sub-pixel of the first pixel group of other rows. The first sub-pixel of the second pixel group of each row is in the same column as the first sub-pixel of the second pixel group of other rows, and the second sub-pixel of the second pixel group of each row is in the same column as the second sub-pixel of the second pixel group of other rows, so that the lighted sub-pixels are arranged alternately in columns. The array substrate on a whole seems to be lighted unevenly, thus one brighter row of sub-pixels and one darker row of sub-pixels are avoided. It is effectively avoided that there is not lighted sub-pixel, and the stability of uniform display is improved.

To achieve the above, with reference to FIG. 2, the present application further proposes an array substrate, including a memory storing a driving program of the array substrate and a processor storing for executing the driving program of the array substrate to realize the driving method of the array substrate;

a plurality of sub-pixels is arranged in an array and divided into a plurality of pixel groups according to two adjacent columns of sub-pixels as a group, each pixel group includes a first sub-pixel and a second sub-pixel provided in turn;

each of a plurality of data drive signal lines is provided between two columns of sub-pixels of each pixel group and electrically connected to each sub-pixel of each pixel group;

a plurality of first row scan drive signal lines ($VG_n$, $VG_{n+2}$, $VG_{n+4}$ . . . $VG_{n+2z}$);

a plurality of second row scan drive signal lines ($VG_{n+1}$, $VG_{n+3}$, $VG_{n+5}$ . . . $VG_{n+2z+1}$);

the first pixel group and the second pixel group is arranged alternately along rows where they are located, the first pixel group is connected to the first row scan drive signal lines ($VG_n$, $VG_{n+2}$, $VG_{n+4}$ . . . $VG_{n+2z}$), the second pixel group is connected to the second row scan drive signal lines ($VG_{n+1}$, $VG_{n+3}$, $VG_{n+5}$ . . . $VG_{n+2z+1}$), and each column of sub-pixel is composed of first sub-pixels or second sub-pixels.

It is worth noting that since the array substrate of the present application includes all the embodiments of the above-mentioned driving method of the array substrate, the array substrate of the present application has all the beneficial effects of the above-mentioned driving method of the array substrate, which will not be repeated here.

In addition, based on a group of two columns of sub-pixels including two data drive signal lines ($VD_m$, $VD_{m+1}$, $VD_{m+2}$ . . . $VD_{m+z}$). In this solution, only one data drive signal line ($VD_m$, $VD_{m+1}$, $VD_{m+2}$ . . . $VD_{m+z}$) is used to drive two columns of sub-pixels simultaneously, thus the number of data drive signal lines of the array substrate is reduced, and the stability of uniform display is ensured.

In one embodiment, as shown in FIG. 2 and FIG. 6, the array substrate further includes a plurality of common electrode signal lines ($V_{stx}$, $V_{stx+1}$ . . . $V_{stx+z}$), each of the common electrode signal lines is provided between two adjacent groups of sub-pixels; stz and z are greater than 1.

In each column of sub-pixels, a common electrode storage capacitance Cst is formed between each of the sub-pixels and the adjacent common electrode signal line.

By the above solution, the opening rate of the display panel is increased, so that the effective light-emitting area of each of sub-pixels is greatly extended, the penetration rate is increased, and the brightness is increased. By combining it with the driving method of the display panel, the overall brightness of the display panel can be improved under the same driving voltage.

Figure 4:
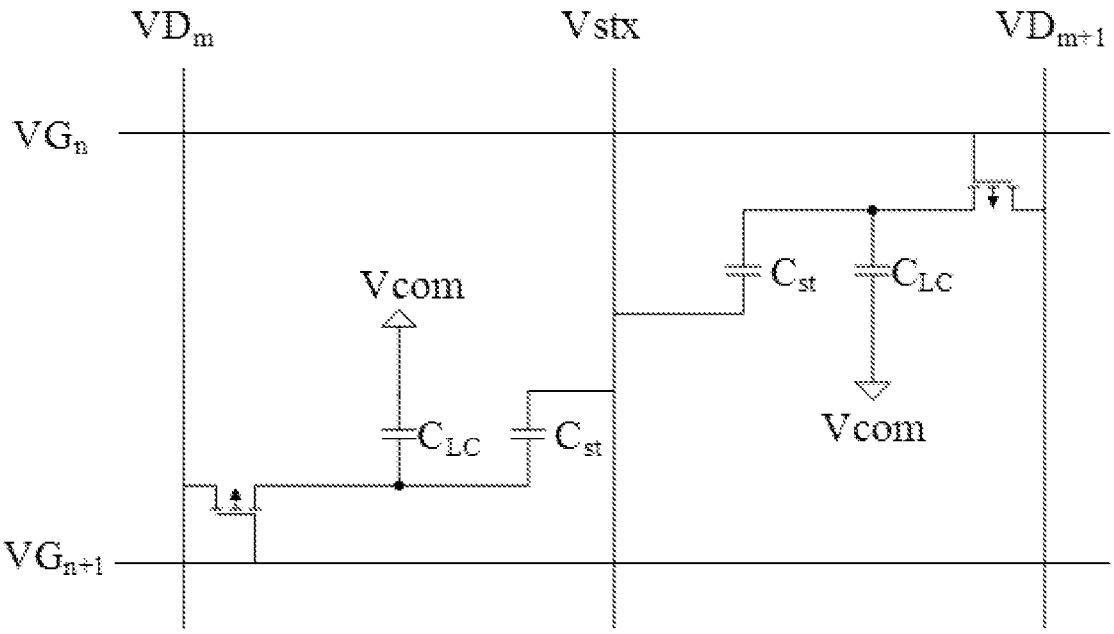
FIG. 4 is a schematic diagram of an equivalent circuit of the array substrate according to the present application.

In one embodiment, referring to FIG. 4, an electrical connection line of the common electrode storage capacitor Cst is described below. One end of each common electrode storage capacitor Cst is connected to a corresponding common electrode signal line ($V_{stx}$, $V_{stx+1}$ . . . $V_{stx+z}$) and the other end of each common electrode storage capacitor $C_{st}$ is connected to the pixel electrode $C_{LC}$ of the corresponding the sub-pixel.

In one embodiment, on a row of sub-pixels of the array structure, three sub-pixels form a pixel unit. Three sub-pixels are a red sub-pixel, a green sub-pixel and a blue sub-pixel in turn. One of the data drive signal lines ($VD_m$, $VD_{m+1}$, $VD_{m+1}$ . . . $VD_{m+z}$) and the common electrode signal lines ($V_{stx}$, $V_{stx+1}$ . . . $V_{stx+z}$) is provided between the red sub-pixel and the green sub-pixel and the other thereof is provided between the blue sub-pixel and the green sub-pixel.

With the above solution, it is possible to ensure that a number of first polar sub-pixels and second polar sub-pixels driven by the data drive signal line is balance, and a number of the three primary colors is also maintained balance to avoid color differences in the final color rendering.

In one embodiment, when there is a plurality of the pixel units, one of the data drive signal lines ($VD_m$, $VD_{m+1}$, $VD_{m+2}$ . . . $VD_{m+z}$) and the common electrode signal lines ($V_{stx}$, $V_{stx+1}$ . . . $V_{stx+z}$) may also be provided between the red sub-pixel of the next pixel unit and the blue sub-pixel of the current pixel unit.

With the above solution, it is possible to ensure that a number of first polar sub-pixels and second polar sub-pixels driven by the data drive signal line is balance, and a number of the three primary colors is also maintained balance to avoid color differences in the final color rendering.

In one embodiment, on a row of sub-pixels of the array structure, four sub-pixels form a pixel unit, four sub-pixels are a red sub-pixel, a green sub-pixel, a blue sub-pixel and a white sub-pixel in turn. One of the data drive signal lines ($VD_m$, $VD_{m+1}$, $VD_{m+2}$ . . . $VD_{m+z}$) and the common electrode signal lines ($V_{stx}$, $V_{stx+1}$ . . . $V_{stx+z}$) is provided between the red sub-pixel and the green sub-pixel and the other thereof is provided between the green sub-pixel and the blue sub-pixel.

With the above solution, it is possible to ensure that a number of first polar sub-pixels and second polar sub-pixels driven by the data drive signal lines ($VD_m$, $VD_{m+1}$, $VD_{m+2}$ . . . $VD_{m+z}$) is balance, and a number of and complementary light of the three primary colors are also maintained balance avoid the color difference and the brightness difference in the final color rendering to ensure the balance of the display and avoid the formation of dark and bright stripes.

Figure 7:
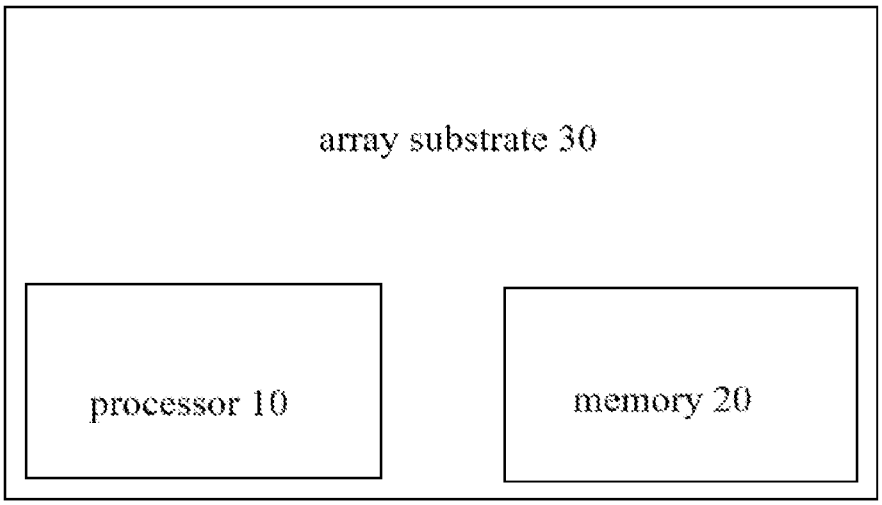
FIG. 7 is a structural diagram of an embodiment of the array substrate according to the present application.

The present application also presents an array substrate 30, as shown in FIGS. 6 and 7, the array substrate 30 includes a memory 20 storing a driving program of the array substrate 30, a processor 10 for executing the driving program of the array substrate 30 to realize the driving method of the array substrate;

a plurality of sub-pixels is arranged in an array and divided into a plurality of first pixel groups and a plurality of second pixel groups according to two adjacent columns of sub-pixels as a group, wherein sub-pixels of the first pixel group and sub-pixels of the second pixel group are arranged alternatively along rows where they are located, and the first pixel group and the second pixel group both includes a first sub-pixel and a second sub-pixel provided in turn;

each of a plurality of data drive signal lines is provided between two columns of sub-pixels of each pixel group and electrically connected to each sub-pixel of each pixel group;

a plurality of first row scan drive signal lines ($VG_n$, $VG_{n+2}$, $VG_{n+4}$ . . . , $VG_{n+2z}$);

a plurality of second row scan drive signal lines ($VG_{n+1}$, $VG_{n+3}$, $VG_{n+5}$ . . . $VG_{n+2z+1}$);

in a same row, a first sub-pixel of each pixel group is connected to the first row scan drive signal line ($VG_n$, $VG_{n+2}$, $VG_{n+4}$ . . . , $VG_{n+2z}$) and a second sub-pixel of each pixel group is connected to the second row scan drive signal line ($VG_{n+1}$, $VG_{n+3}$, $VG_{n+5}$ . . . $VG_{n+2z+1}$), wherein each column of sub-pixels is composed of any one of the first sub-pixel of the first pixel group, the second sub-pixel of the first pixel group, the first sub-pixel of the second pixel group, and the second sub-pixel of the second pixel group, and wherein a data drive signal line connected to the first pixel group is a first data drive signal line, and a data drive signal line connected to the second pixel group is a second data drive signal line.

It is worth noting that since the array substrate of the present application includes all the embodiments of the above-mentioned driving method of the array substrate, the array substrate of the present application has all the beneficial effects of the above-mentioned driving method of the array substrate, which will not be repeated here.

The present application also proposes a display panel, the display panel includes a color film substrate, a liquid crystal and an array substrate as described above, the array substrate, liquid crystal and the color film substrate are stacked in turn.

It is worth noting that because the display panel of the present application contains all the above-mentioned embodiments of the array substrate, the display panel of the present application has all the beneficial effects of the above-mentioned array substrate, which will not be repeated here.

The above is only an optional embodiment of the present application, not to limit the claimed scope of the present application. Any equivalent structural transformation made by using the contents of the specification and the attached drawings of the present application under the application concept of the present application, or direct/indirect application in other related technical fields are included in the claimed scope of the present application.

The invention claimed is:

1. A driving method of an array substrate, wherein the array substrate comprises:

a plurality of sub-pixels arranged in an array and divided into a plurality of pixel groups according to two adjacent columns of sub-pixels as a group, each pixel group comprising first sub-pixels and second sub-pixels provided in turn;

each of a plurality of data drive signal lines provided between two columns of sub-pixels of each pixel group and electrically connected to each sub-pixel of the pixel group;

a plurality of first row scan drive signal lines;

a plurality of second row scan drive signal lines;

in a same row, a first sub-pixel of each pixel group being connected to a first row scan drive signal line and a second sub-pixel of each pixel group being connected to a second row scan drive signal line, each column of sub-pixels being composed of first sub-pixels or second sub-pixels;

wherein the driving method of the array substrate comprises:

controlling the plurality of data drive signal lines to output a first polarity data drive signal in a first time period and output a second polarity data drive signal in a second time period alternately;

outputting the first polarity data drive signal to drive the first sub-pixels of each pixel group to make the first sub-pixels of each pixel group to be a first polarity in the first time period; and outputting the second polarity data drive signal to drive the second sub-pixels of each pixel group to make the second sub-pixels of each pixel group to be a second polarity in the second time period, wherein polarities of sub-pixels of each column of sub-pixels are same.

2. The driving method of the array substrate according to claim 1, wherein the outputting the first polarity data drive signal to drive the first sub-pixels of each pixel group comprises:

driving first sub-pixels of each row connected to the first row scan drive signal line in turn with the first polarity data drive signal along an extension direction of the data drive signal line.

3. The driving method of the array substrate according to claim 1, wherein the outputting the second polarity data drive signal to drive the second sub-pixels of each pixel group comprises:

driving second sub-pixels of each row connected to the second row scan drive signal line in turn with the second polarity data drive signal along an extension direction of the data drive signal line.

4. A driving method of an array substrate, wherein the array substrate comprises:

a plurality of sub-pixels arranged in an array and divided into a plurality of first pixel groups and a plurality of second pixel groups according to two adjacent columns of sub-pixels as a group, the plurality of first pixel groups and the plurality of second pixel groups being arranged alternatively along rows where the plurality of first pixel groups and the plurality of second pixel groups are located, each of the plurality of first pixel groups and the plurality of second pixel groups comprising first sub-pixels and second sub-pixels arranged in turn;

a plurality of data drive signal lines, each data drive signal line being provided between two columns of sub-pixels of each pixel group and electrically connected to sub-pixels of each pixel group;

a plurality of first row scan drive signal lines;

a plurality of second row scan drive signal lines;

wherein in a same row, first sub-pixel of each pixel group being connected to a first row scan drive signal line and second sub-pixels of each pixel group being connected to a second row scan drive signal line, wherein each column of sub-pixels is composed of any one of the first sub-pixels of a first pixel group, second sub-pixels of the first pixel group, the first sub-pixels of a second pixel group, and the second sub-pixels of the second pixel group, wherein a data drive signal line connected to a first pixel group is a first data drive signal line and a data drive signal line connected to the second pixel group is a second data drive signal line;

wherein the driving method of the array substrate comprises:

controlling the plurality of data drive signal lines to output a first polarity data drive signal in a first time period and output a second polarity data drive signal in a second time period alternately;

in the first time period, outputting, by the first data drive signal line, the first polarity data drive signal to drive the first sub-pixels of the first pixel group, and outputting, by the second data drive signal line, the second polarity data drive signal to drive the first sub-pixels of the second pixel group; and in the second time period, outputting, by the first data drive signal line, the second polarity data drive signal to the second row scan drive signal line to drive the second sub-pixels of the first pixel group, outputting, by the second data drive signal line, the first polarity data drive signal to the second row scan drive signal line to drive the second sub-pixel of the second pixel group, a polarity of one of two sub-pixels of the first pixel group being a first polarity and a polarity of the other of the two sub-pixels of the first pixel group being a second polarity, and a polarity of two sub-pixels of the second pixel group being the first polarity and a polarity of the other of the two sub-pixels of the second pixel group being the second polarity, wherein a polarity of each column of sub-pixels is a polarity of each sub-pixel of a first row.

5. The driving method of the array substrate according to claim 4, wherein the first polarity represents a voltage of the first polarity data drive signal greater than a voltage of a common electrode; and the second polarity represents a voltage of the second polarity data drive signal less than the voltage of the common electrode.

6. The driving method of the array substrate according to claim 4, wherein the first polarity represents a voltage of the first polarity data drive signal greater than a voltage of a common electrode; and the second polarity represents a voltage of the second polarity data drive signal less than the voltage of the common electrode.

7. The driving method of the array substrate according to claim 4, wherein a time span of the first time period is equal to a time span of the second time period.

8. The driving method of the array substrate according to claim 4, wherein a time span of the first time period is equal to a time span of the second time period.

9. The driving method of the array substrate according to claim 4, wherein an interval from the first time period to the second time period is basically less than the perception time of the user's eyes.

10. The driving method of the array substrate according to claim 4, wherein an interval from the first time period to the second time period is basically less than the perception time of the user's eyes.

11. An array substrate, comprising a memory storing a driving program of the array substrate;

a processor for executing the driving program of the array substrate to realize a driving method of the array substrate;

a plurality of sub-pixels arranged in an array and being divided into a plurality of first pixel groups and a plurality of second pixel groups according to two adjacent columns of sub-pixels as a group, wherein sub-pixels of the first pixel group and sub-pixels of the second pixel group are arranged alternatively along rows where they are located, and the first pixel group and the second pixel group both comprises first sub-pixels and second sub-pixels provided in turn;

each of a plurality of data drive signal lines provided between two columns of sub-pixels of each pixel group and electrically connected to each sub-pixel of the pixel group;

a plurality of first row scan drive signal lines;

a plurality of second row scan drive signal lines;

in a same row, a first sub-pixel of each pixel group being connected to a first row scan drive signal line and a second sub-pixel of each pixel group being connected to a second row scan drive signal line, wherein each column of sub-pixels is composed of any one of the first sub-pixel of the first pixel group, the second sub-pixel of the first pixel group, the first sub-pixel of the second pixel group, and the second sub-pixel of the second pixel group, wherein a data drive signal line connected to the first pixel group is a first data drive signal line, and a data drive signal line connected to the second pixel group is a second data drive signal line;

wherein the driving method of the array substrate comprises:

controlling the plurality of data drive signal lines to output a first polarity data drive signal in a first time period and output a second polarity data drive signal in a second time period alternately, outputting the first polarity data drive signal to drive the first sub-pixels of each pixel group to make the first sub-pixels of each pixel group to be a first polarity in the first time period; and outputting the second polarity data drive signal to drive the second sub-pixels of each pixel group to make the second sub-pixels of each pixel group to be a second polarity in the second time period, wherein polarities of sub-pixels of each column of sub-pixels are same.

12. The array substrate according to claim 11, further comprising a plurality of common electrode signal lines, each common electrode signal line being provided between two adjacent groups of pixels;

in each column of sub-pixels, a common electrode storage capacitor being provided between each sub-pixel and an adjacent common electrode signal line, one end of each common electrode storage capacitor being connected to a corresponding common electrode signal line, and the other end of each of common electrode storage capacitor being connected to a pixel electrode of a corresponding sub-pixel.

13. The array substrate according to claim 11, wherein the outputting the first polarity data drive signal to drive the first sub-pixels of each pixel group comprises:

driving first sub-pixels of each row connected to the first row scan drive signal line in turn with the first polarity data drive signal along an extension direction of the data drive signal line.

14. The array substrate according to claim 11, wherein the outputting the second polarity data drive signal to drive the second sub-pixels of each pixel group comprises:

driving second sub-pixels of each row connected to the second row scan drive signal line in turn with the second polarity data drive signal along an extension direction of the data drive signal line.

15. The array substrate according to claim 11, wherein the first polarity represents a voltage of the first polarity data drive signal greater than a voltage of a common electrode; and the second polarity represents a voltage of the second polarity data drive signal less than the voltage of the common electrode.

16. The array substrate according to claim 11, wherein a time span of the first time period is equal to a time span of the second time period.

17. The array substrate according to claim 11, wherein an interval from the first time period to the second time period is basically less than the perception time of the user's eyes.

* * * * *